US011142996B2

(12) United States Patent
Ali et al.

(10) Patent No.: US 11,142,996 B2
(45) Date of Patent: Oct. 12, 2021

(54) MILLING AND WHIPSTOCK ASSEMBLY WITH FLOW DIVERSION COMPONENT

(71) Applicants: Mohsen Alieldin Ali, Houston, TX (US); James Scott Trahan, Magnolia, TX (US); William A. Hered, Houston, TX (US)

(72) Inventors: Mohsen Alieldin Ali, Houston, TX (US); James Scott Trahan, Magnolia, TX (US); William A. Hered, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 28 days.

(21) Appl. No.: 16/352,149

(22) Filed: Mar. 13, 2019

(65) Prior Publication Data

US 2020/0291748 A1 Sep. 17, 2020

(51) Int. Cl.

| | |
|---|---|
| ***E21B 29/06*** | (2006.01) |
| ***E21B 34/10*** | (2006.01) |
| ***E21B 29/00*** | (2006.01) |
| ***E21B 23/00*** | (2006.01) |

(52) U.S. Cl.

CPC ..... *E21B 34/10* (2013.01); *E21B 23/006* (2013.01); *E21B 29/002* (2013.01); *E21B 29/06* (2013.01); *E21B 2200/06* (2020.05)

(58) Field of Classification Search

CPC ..... E21B 29/06; E21B 29/002; E21B 7/061; E21B 23/006

See application file for complete search history.

(56) References Cited

U.S. PATENT DOCUMENTS

| | | | | |
|---|---|---|---|---|
| 5,163,522 | A | 11/1992 | Eaton et al. | |
| 5,806,596 | A * | 9/1998 | Hardy | E21B 34/14 166/298 |
| 5,890,540 | A | 4/1999 | Pia et al. | |
| 6,050,334 | A | 4/2000 | McGarian et al. | |

(Continued)

OTHER PUBLICATIONS

International Search Report for International Application No. PCT/US2020/016501; International Filing date: Feb. 4, 2020; dated May 28, 2020; 3 pages.

(Continued)

*Primary Examiner* — Catherine Loikith

(74) *Attorney, Agent, or Firm* — Cantor Colburn LLP

(57) ABSTRACT

An apparatus for performing a milling operation includes a mill having an internal fluid conduit and a fluid port configured to connect the internal fluid conduit to an exterior of the mill. A moveable flow diversion component is configured to move axially in the internal conduit from a first axial position in which fluid is prevented from flowing between the internal fluid conduit and the fluid port, to a second axial position in which the internal fluid conduit is in fluid communication with the fluid port. The apparatus also includes one or more slots configured to engage one or more pins extending into the internal fluid conduit, the one or more slots defining a path that directs movement of the flow diversion component. The flow diversion component is configured to be moved from the first to the second axial position by changing fluid pressure in the internal fluid conduit.

20 Claims, 7 Drawing Sheets

(56) References Cited

U.S. PATENT DOCUMENTS

| | | | | |
|---|---|---|---|---|
| 6,116,336 | A * | 9/2000 | Adkins | E21B 21/10 166/55.7 |
| 6,173,795 | B1 | 1/2001 | McGarian et al. | |
| 6,899,179 | B2 * | 5/2005 | McGarian | E21B 23/006 166/332.2 |
| 7,669,672 | B2 * | 3/2010 | Brunet | E21B 7/061 166/117.6 |
| 9,863,214 | B2 * | 1/2018 | Cronley | E21B 23/06 |
| 2015/0184460 | A1 | 7/2015 | Alsup et al. | |

OTHER PUBLICATIONS

Written Opinion for International Application No. PCT/US2020/016501; International Filing date: Feb. 4, 2020; dated May 28, 2020; 6 pages.

* cited by examiner

MILLING AND WHIPSTOCK ASSEMBLY WITH FLOW DIVERSION COMPONENT

BACKGROUND

In the resource recovery industry, milling tools, or mills, are used to perform cutting tasks within a subterranean borehole. Milling tools are often employed to cut away discrete objects within or associated with a borehole. In addition, window milling tools are utilized to open sidetracks or secondary holes from a main borehole. Whipstocks are common mechanisms for directing a milling tool to mill an initial portion of a secondary borehole.

SUMMARY

An embodiment of an apparatus for performing aspects of a milling operation, the apparatus includes a mill configured to be rotated to mill a section of a borehole, the mill including an internal fluid conduit in fluid communication with a borehole string, the mill including a fluid port configured to connect the internal fluid conduit to an exterior of the mill; a moveable flow diversion component configured to move axially in the internal conduit from a first axial position in which fluid is prevented from flowing between the internal fluid conduit and the fluid port, to a second axial position in which the internal fluid conduit is in fluid communication with the fluid port; and one or more slots formed in the flow diversion component and configured to engage one or more pins extending into the internal fluid conduit, the one or more slots defining a path that directs movement of the flow diversion component, wherein the flow diversion component is configured to be moved from the first axial position to the second axial position by changing fluid pressure in the internal fluid conduit.

An embodiment of a method of performing aspects of a milling operation, that includes deploying a milling assembly in a borehole, the milling assembly including a mill having an internal fluid conduit in fluid communication with a borehole string, the mill including a fluid port configured to connect the internal fluid conduit to an exterior of the mill, the milling assembly including a moveable flow diversion component configured to move axially in the internal conduit from a first axial position in which fluid is prevented from flowing between the internal fluid conduit and the fluid port, to a second axial position in which the internal fluid conduit is in fluid communication with the fluid port; and controlling fluid pressure in the internal fluid conduit on the flow diversion component to move the flow diversion component from the first axial position to the second axial position, wherein movement of the flow diversion component is guided by one or more pins extending into the internal fluid conduit and engaging one or more slots formed in the flow diversion component, the one or more slots defining a path that directs the movement of the flow diversion component; and circulating fluid through the borehole string and the mill and rotating the mill to form an initial section of a secondary borehole that extends from the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
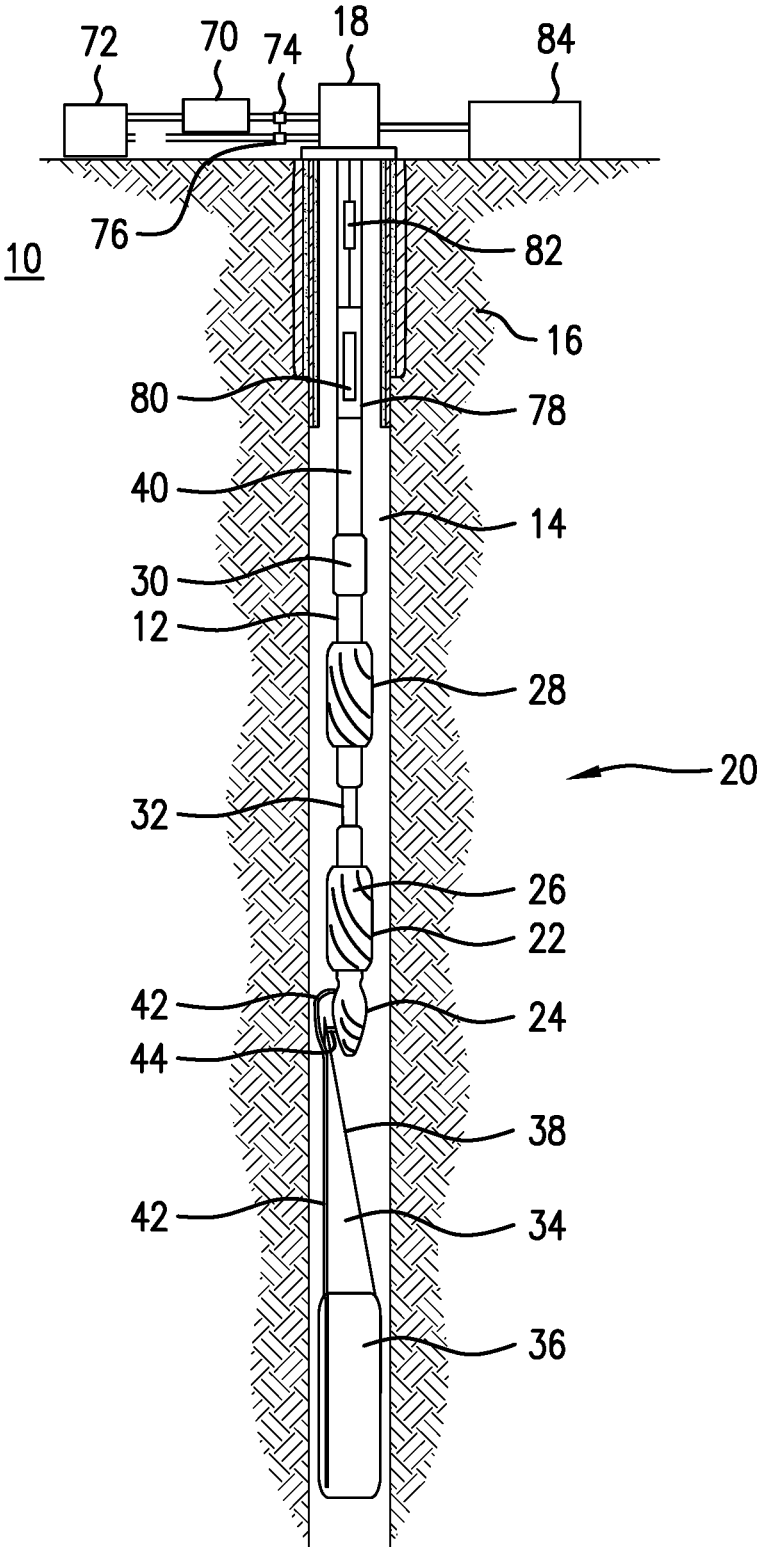
FIG. 1 depicts an embodiment of a well milling and/or drilling system that includes a hydraulically controllable moveable flow diversion component.

Referring to FIG. 1, an embodiment of a well milling and/or drilling system 10 includes a borehole string 12 that is shown disposed in a well or borehole 14 that penetrates at least one resource bearing (or potentially resource bearing) formation 16 during a drilling, milling or other downhole operation. As described herein, "borehole" or "wellbore" refers to a hole that makes up all or part of a drilled well. It is noted that the borehole 14 may include vertical, deviated and/or horizontal sections, and may follow any suitable or desired path. As described herein, "formations" refer to the various features and materials that may be encountered in a subsurface environment and surround the borehole 14. Although a milling and/or drilling system is shown in FIG. 1, embodiments described herein may be suitable in a variety of energy industry systems and processes, such as stimulation, production, measurement and/or completion systems and processes.

A surface structure or surface equipment 18 includes or is connected to various components such as a wellhead, derrick and/or rotary table for performing various functions, such as supporting the borehole string 12, deploying the borehole string 12 (including tools and components, such as a milling assembly) into the borehole 14, rotating the borehole string 12, communicating with downhole components, performing surface measurements and/or performing downhole measurements. In one embodiment, the borehole string 12 is a drill string or milling string including one or more drill pipe sections that extends downward into the borehole 14.

In one embodiment, the system 10 includes a milling apparatus or assembly 20 configured to be controlled to form an initial length (sometimes referred to as a "rathole") of a secondary borehole extending from the borehole 12. The borehole 12 in such an embodiment is referred to herein as a primary borehole or pilot borehole. One or more components of the milling assembly 20 can be configured as a bottomhole assembly (BHA).

Operations that include forming ratholes and/or secondary boreholes are referred to, for examples, as sidetracking operations. Other operations that can be performed using the milling assembly include cutting or removing downhole components, enlarging a borehole (underreaming) and cutting a section of casing to drill a secondary borehole from the borehole 12.

The system 10 of FIG. 1 is described as being configured to form secondary boreholes from an open hole section of the primary borehole 12, but is not so limited. For example, the system 10 can also form secondary boreholes from cased sections of the primary borehole 12. In this example, the system 10 mills or otherwise forms a window in the casing, through which a secondary borehole is milled and/or drilled.

The milling assembly 20 includes one or more mills, such as a lead milling device 22 having a lead mill 24 and a following mill 26. The lead mill 24 is a tapered mill designed to initiate cutting into the side of the borehole 14 (or casing). The following mill 26 is a watermelon mill or other suitable type of mill. The milling assembly 20 may also include additional milling devices or subs, such as an upper milling device 28 having a watermelon mill. Each of the lead mill 24, the following mill 26 and the upper milling device 28 include suitable cutting components, such as arrays of cutters made of, for example, tungsten carbide. The cutters may be inserts attached to a mill body or formed integral with the mill body. Any suitable type or configuration of cutting elements may be employed to cut, mill, grind or otherwise remove formation materials.

The milling assembly 20 may include additional components to facilitate sidetracking, milling and other operations. For example, the milling assembly 20 includes a drill collar 30 for adding weight to the milling assembly 20, and a flex joint 32 between the lead milling device 22 and the upper milling device 28.

It is noted that terms such as "upper," "lower," "upward", "downward," "uphole" and "downhole" are used herein to describe relative positions of various components. Such terms are used to denote relative positions of components along a borehole with respect to a surface end of the borehole, which may or may not correspond to vertical depth locations, as the borehole 12 and/or secondary boreholes may not be vertical. For example, the borehole 12 and secondary boreholes can have deviated and/or horizontal sections. Thus, for example, an upper location refers to a location that is closer to the surface along the path of the borehole than a reference location; as the path may be deviated, horizontal or directed toward the surface, the upper location may be at the same or similar vertical depth, or even below the reference location.

The system 10, in one embodiment, includes a whipstock assembly having a whipstock 34 and an anchor 36. The whipstock 34 includes a ramp 38 that guides the milling assembly 20 by urging the lead milling device 22 and the upper milling device 28 laterally to initiate and mill a rathole. The whipstock 34 is temporarily attached to the milling assembly 20 so that the whipstock 34 and the anchor 36 are deployed downhole with the milling assembly 20, and the milling assembly 20 can be detached from the whipstock 34 after the anchor 36 is set.

The anchor 36, in one embodiment, is a hydraulically actuated anchor that is set by directing fluid pressure to the anchor 36 to cause components of the anchor 36 to be moved laterally and abut the borehole 14. For example, a hydraulic whipstock valve 40 is connected to the anchor 36 via one or more fluid conduits in the milling assembly 20. The fluid conduit(s) is/are connected to an umbilical 42 that extends from the lead mill 24 to the anchor 36. To set the anchor 36, fluid pressure is applied through the umbilical to actuate features such as one or more bladders or one or more arms that are hydraulically activated. For example, applying a sufficient pressure causes shear screws (not shown) in the anchor 36 to be shorn off and permit fluid to expand bladders or valves to set the anchor 36.

After the anchor 36 is set and the whipstock 34 is secured in place, the milling assembly 20 is detached from the whipstock 34 so that the milling assembly 20 can be rotated and advanced along the whipstock ramp 38 to mill an initial portion of a secondary borehole. In one embodiment, the lead mill 24 is removably attached to the whipstock 34 by a shear bolt 44. When sufficient weight is applied to the milling assembly 20, the shear bolt 44 shears or otherwise breaks to detach the lead mill 24.

Figure 2:
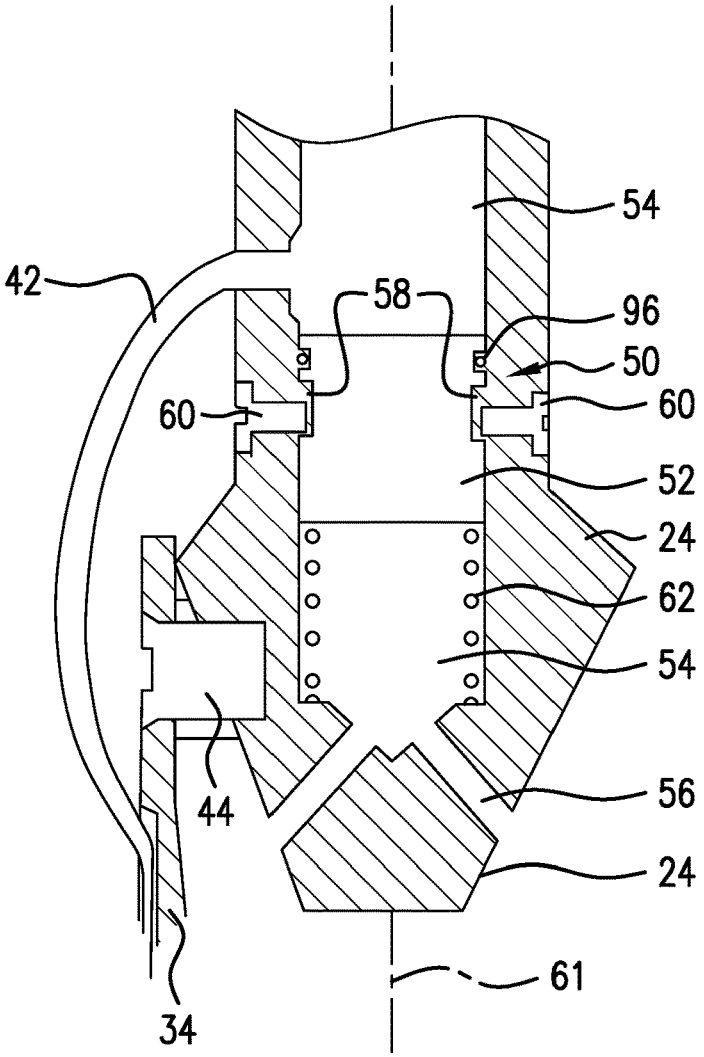
FIG. 2 depicts an embodiment of the flaw diversion component of FIG. 1, which includes one or more slots that engage one or more pins to guide the flow diversion component between a closed position and an open position.

Referring to FIG. 2, the system 10 includes a fluid diversion assembly 50 that is configured to direct fluid to the lead mill 24 or otherwise direct fluid to the milling assembly 20 to facilitate milling after the anchor 36 is set. The fluid diversion assembly 50 includes a hydraulically actuated moveable component 52, which in one embodiment is a cylindrical sleeve 52 configured to move axially along an internal fluid conduit 54. The internal fluid conduit 54 is in fluid communication with the borehole string 12 (e.g., with a central or main fluid bore or conduit in the borehole string 12). The lead mill 24 includes one or more fluid ports 56 to allow fluid to be circulated through the borehole 12 and the lead mill 24, and returned to the surface through an annulus of the borehole 14.

In one embodiment, the internal fluid conduit 54 is connected to the umbilical 42 so that fluid can be flowed into the anchor 36 when the whipstock valve 40 is actuated or controlled. The sleeve 52 can be actuated hydraulically by applying fluid pressure to the sleeve 52 to move the sleeve 52 from a closed position to an open position. In the closed position, the sleeve 52 obstructs or otherwise prevents fluid form flowing from the internal fluid conduit 54 to the fluid ports 56. In the open position, the internal fluid conduit is in fluid communication with the fluid ports 56.

To facilitate movement of the sleeve 52, the fluid diversion assembly includes a slot mechanism that includes one or more slots 58 that interact with respective guide pins 60 that extend laterally (e.g., at least partially orthogonal to a longitudinal axis 61 of the internal fluid conduit 54) into the internal fluid conduit 54. The guide pins 60 and the slots 58 define a movement path that guides axial movement of the sleeve 52 between the open position and the closed position. The fluid diversion assembly 50 also includes a biasing element or mechanism such as a spring 62 that biases the sleeve 52 upward, i.e., away from the cutting end of the lead mill 24. The spring 62 and the slots 58 operate in concert to guide the sleeve 52 between the open position and the closed position.

As discussed in more detail below, the spring 62 biases the sleeve 52 toward the closed position. The stiffness of the spring 62 is selected so that fluid pressures below a selected threshold do not compress the spring 62. The threshold may be selected based on the fluid pressure necessary to open the whipstock valve 40, e.g., the spring 62 has a stiffness that is selected so that the spring 62 compresses when pressure exceeds a threshold that is greater than the pressure needed to open the whipstock valve 40 and actuate the anchor 36.

The milling assembly 20 can be driven from the surface and/or downhole. For example, the borehole string 12 can be rotated by the surface equipment 18, or the milling assembly 20 can be rotated by a downhole motor or mud motor. Flow properties of fluid circulated through the mud motor, such as pressure and flow rate, can be controlled to control the speed of the mud motor.

Referring again to FIG. 1, the surface equipment 18 includes components to facilitate circulating fluid such as drilling mud through the borehole string 12. The components also allow for control of fluid flow rate and/or pressure to actuate the whipstock valve 40 and the fluid diversion assembly 50, and to circulate fluid during milling of an initial portion of a secondary borehole and subsequent drilling. For example, a pumping device 70 is located at the surface to circulate fluid from a mud pit or other fluid source 72 into the borehole 14 and control fluid flow and/or pressure to realize various functions and methods described herein.

Surface and/or downhole sensors or measurement devices may be included in the system 10 for measuring and monitoring aspects of an operation, fluid properties, component characteristics and others. For example, the system 10 includes fluid pressure and/or flow rate sensors 74 and 76 for measuring fluid flow into and out of the borehole 12, respectively. Fluid flow characteristics may also be measured downhole, e.g., via fluid flow rate and/or pressure sensors in the borehole string 12.

The borehole string 12 may include additional tools and/or sensors for measuring various properties and conditions. For example, the borehole string 12 includes a LWD or MWD measurement tool 78 that has one or more sensors or sensing devices 80 for detecting and/or analyzing formation measurements, such as resistivity, seismic, acoustic, gamma ray, and/or nuclear measurements. The one or more sensing devices 80 can be configured to measure borehole conditions (e.g., temperature, flow rate, pressure, chemical composition and others) and/or tool conditions (vibration, wear, strain, stress, orientation, location and others).

In one embodiment, one or more downhole components and/or one or more surface components are in communication with and/or controlled by a processor such as a downhole processor 82 and/or a surface processing unit 84. In one embodiment, the surface processing unit 84 is configured as a surface control unit which controls various parameters such as rotary speed, weight-on-bit, fluid flow parameters (e.g., pressure and flow rate) and others.

Referring again to FIG. 2, in one embodiment, the one or more slots 58 are in a J-slot configuration and are referred to herein as J-slots 58. It is noted that although the slots 58 are described as J-slots they are not so limited and can form any suitable shape or path that permits axial movement of the sleeve 52 between the open position and the closed position. The J-slots 58 may be grooves or indentations in the wall of the sleeve 50 or may extend completely through the wall.

Figure 3:
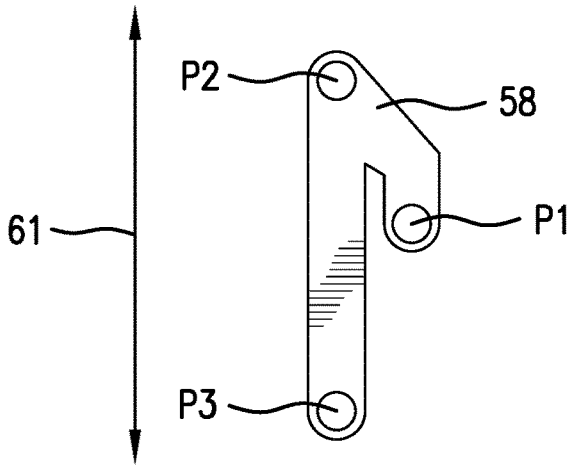
FIG. 3 depicts an example of a slot in the flow diversion component of FIG. 2.

FIG. 3 shows an example of a J-slot 58. The J-slot 58 forms a path that guides a respective guide pin 60, and consequently the sleeve 52, between the open position and the closed position. In operation, the sleeve 52 is in the closed position when the guide pin 60 is at position P1. The J-slot 58 is oriented so that the upward bias of the spring 62 biases the J-slot 58 upward and holds the sleeve 52 in the open position (where the guide pin 60 is at position P3).

When sufficient pressure is applied to the sleeve 52, the sleeve is forced downward (i.e., toward the cutting end of the lead mill 24) and the sleeve 52 slightly rotates. At this point, the guide pin 60 is at position P2. When the pressure is reduced, the spring 62 forces the sleeve 52 upward until the guide pin 60 is at position P3. At this point, fluid communication is established between the internal fluid conduit 54 and the fluid ports 56.

Figure 4:
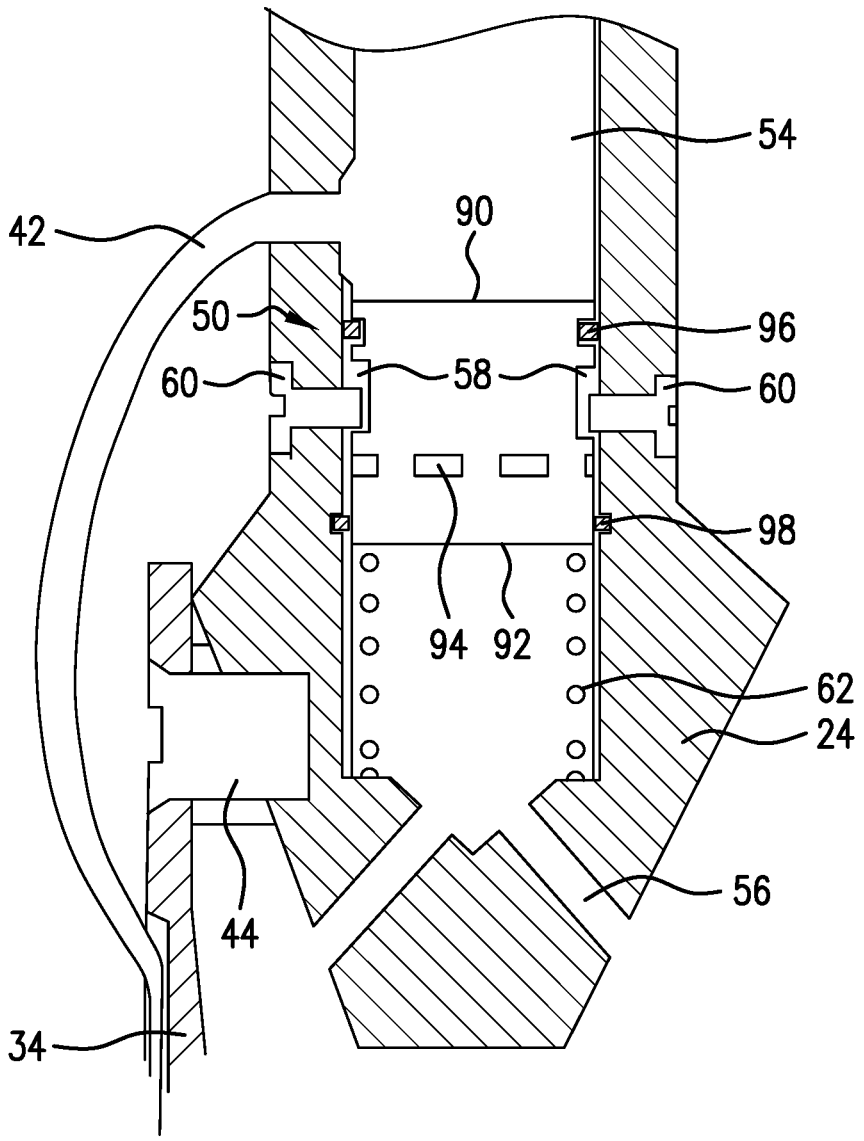
FIG. 4 depicts an embodiment of the flow diversion component of FIG. 1 in a closed, position.
Figure 5:
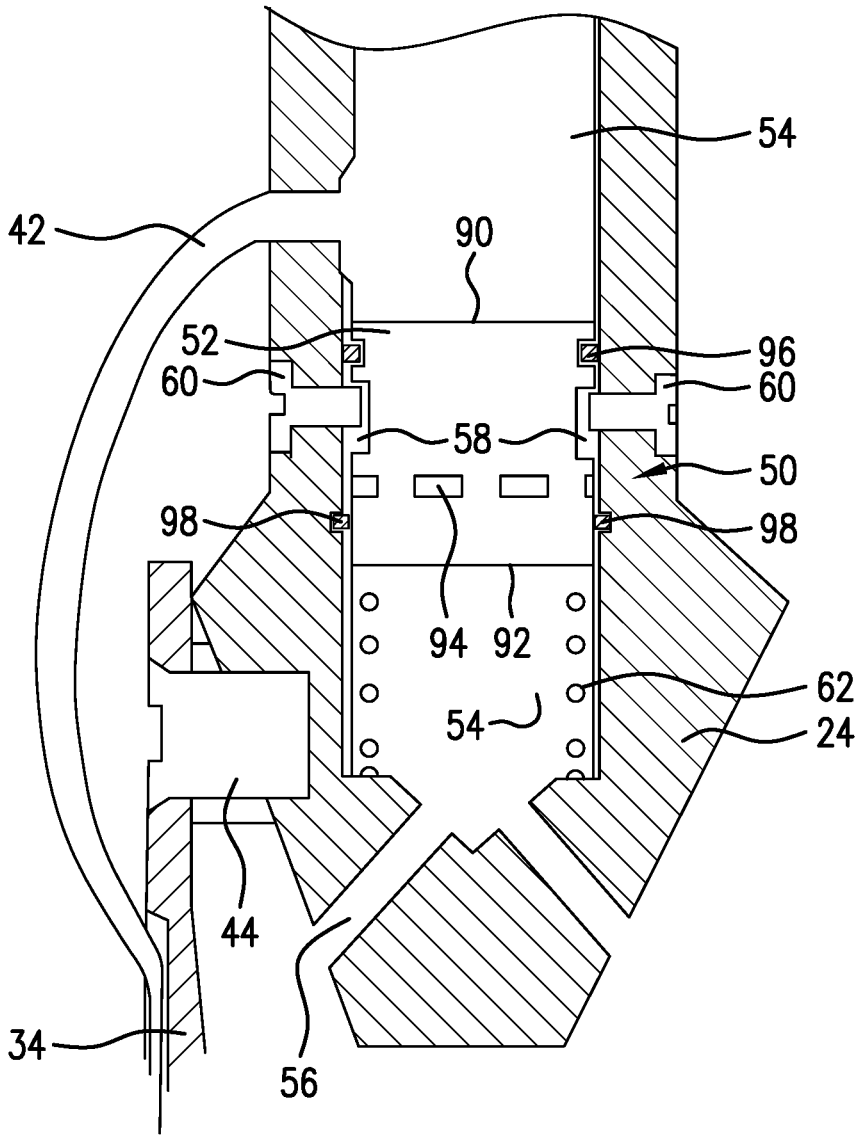
FIG. 5 depicts an embodiment of the flow diversion component of FIGS. 1 and 4 in an intermediate position.
Figure 6:
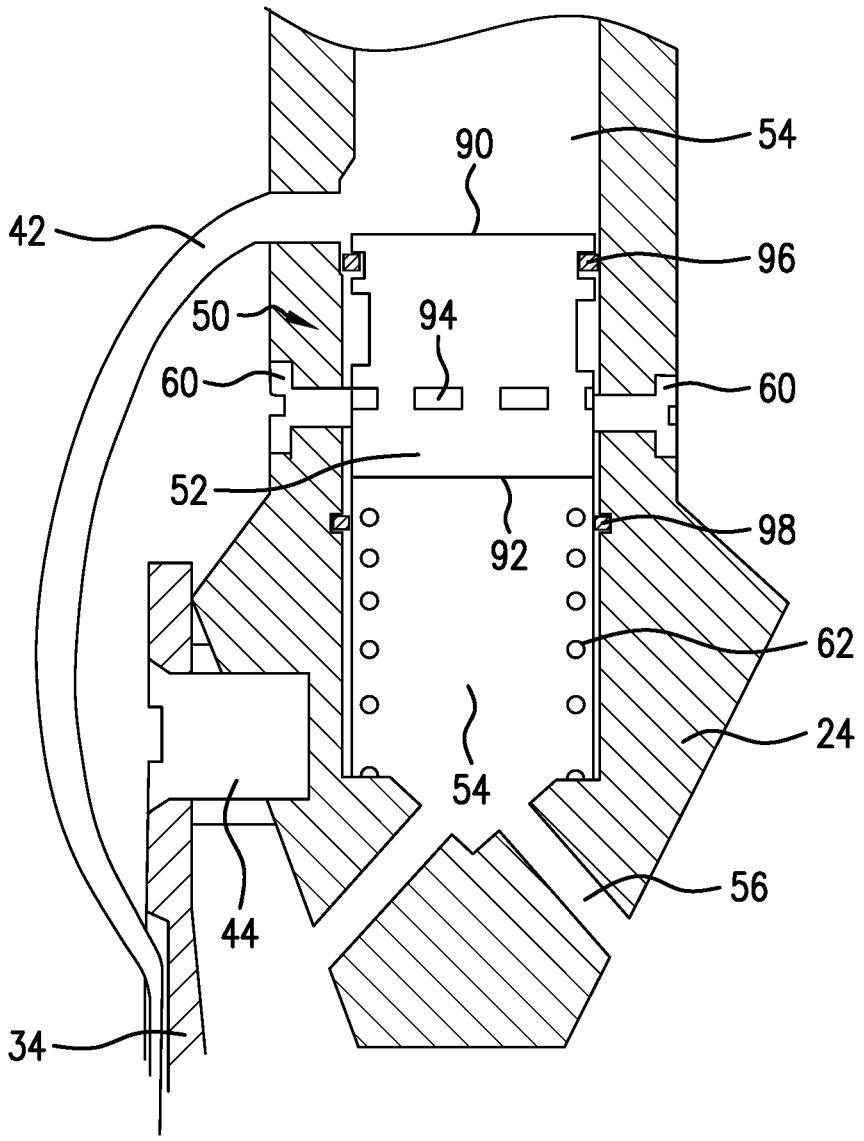
FIG. 6 depicts an embodiment of the flow diversion component of FIGS. 1, 4 and 5 in an open position.

FIGS. 4-6 show an example of the fluid diversion assembly 50 and positions of the sleeve 52. In this example, the sleeve 52 has an open end 90 that permits fluid to flow into the interior of the sleeve 52, and a closed end 92 that blocks fluid from flowing through the closed end 92. A plurality of passages 94 extend through the side wall of the sleeve 52. The sleeve 52 also includes a sealing device 96 such as an o-ring that seals the wall against the inner surface of the internal fluid conduit 54. Another sealing device 96 such as an o-ring is disposed in a groove in the inner surface or otherwise fixedly disposed relative to the inner surface.

In a first position or closed position, shown in FIG. 4, the sealing devices 96 and 98, or at least the sealing device 98, prevents fluid from flowing through the passages 94 to the flow ports 56. Also in the closed position, the spring 62 is loaded so that the sleeve 52 is biased upward and the guide pins 60 are at position P1 along the J-slots 58.

As shown in FIG. 5, when sufficient fluid pressure is applied to the sleeve 52 to overcome the stiffness of the spring 62, the spring 62 compresses and the sleeve 52 is moved downward to an intermediate position. In this position, the guide pins are at position P2.

Pressure on the sleeve 52 can then be reduced so that the spring 62 expands and urges the sleeve 52 upwardly into the second or open position, as shown in FIG. 6. In this position, the wall of the sleeve 52 has moved past the sealing device 98 and fluid communication is established between the internal fluid conduit above the sleeve 52 and the fluid ports 56 through the passages 94.

Figure 7:
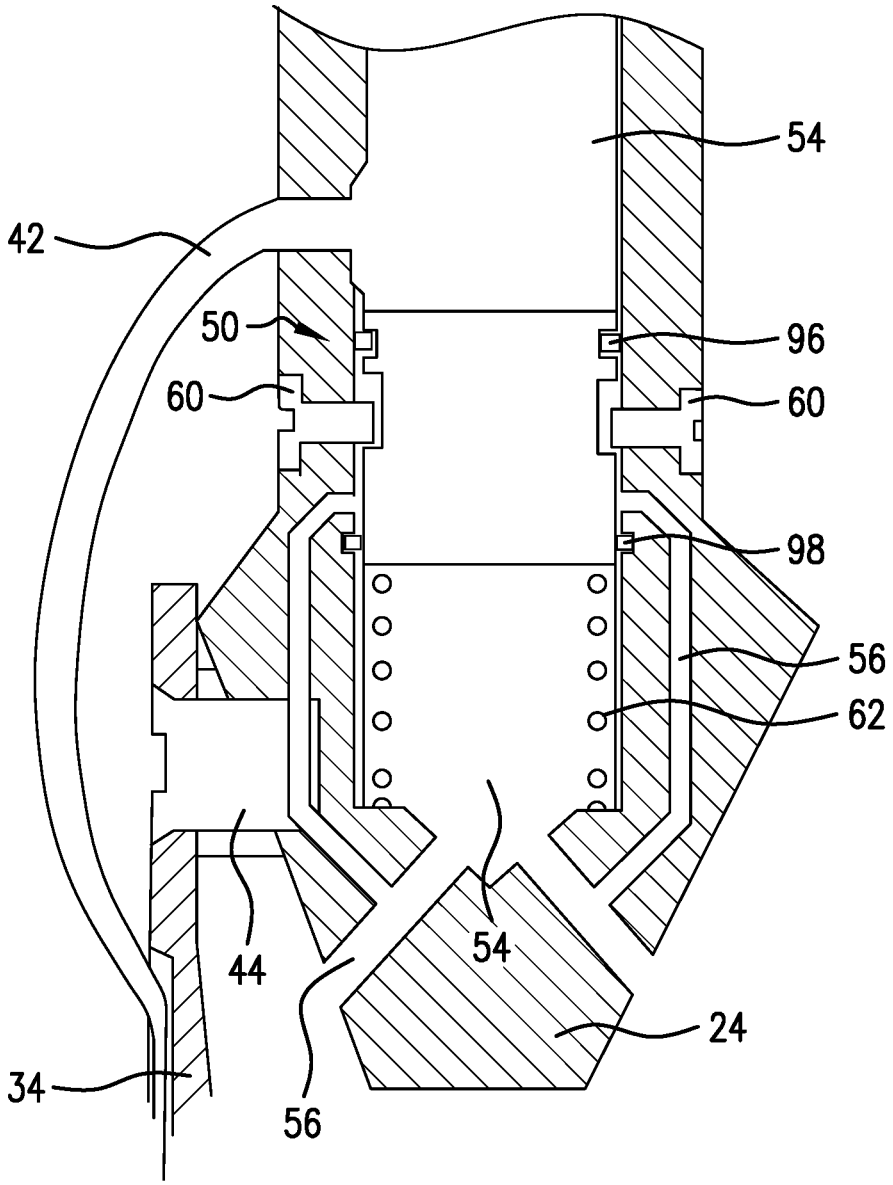
FIG. 7 depicts an embodiment of the flow diversion component of FIG. 1, which includes one or more slots that engage one or more pins to guide the flow diversion component between a closed position and an open position.

FIG. 7 shows another example of the fluid diversion assembly 20. In this example, the fluid ports 56 extend to and terminate at the inner surface of the internal fluid conduit 54. When in the first or closed position, the wall of the sleeve 52 obstructs the fluid ports 56, and the wall in combination with the sealing devices 96 and 98 prevent fluid from entering the fluid ports 56. The sleeve 52 is moved in a similar manner as discussed above, by increasing fluid pressure and subsequently reducing the pressure to move the sleeve 52 toward the open position. In the open position, the wall is moved axially so that it is above the fluid ports 56 at the inner surface and permits fluid flow into the fluid ports.

The sleeve 52 can be configured so that the wall of the sleeve 52 or other portion of the sleeve 52 moves axially upward to obstruct the entry into the umbilical 42 when the sleeve 52 is in the open position. However, the sleeve 52 in some embodiments need not obstruct the umbilical 42, as fluid already has filled the umbilical 42 due to activation of the anchor 36.

Figure 8:
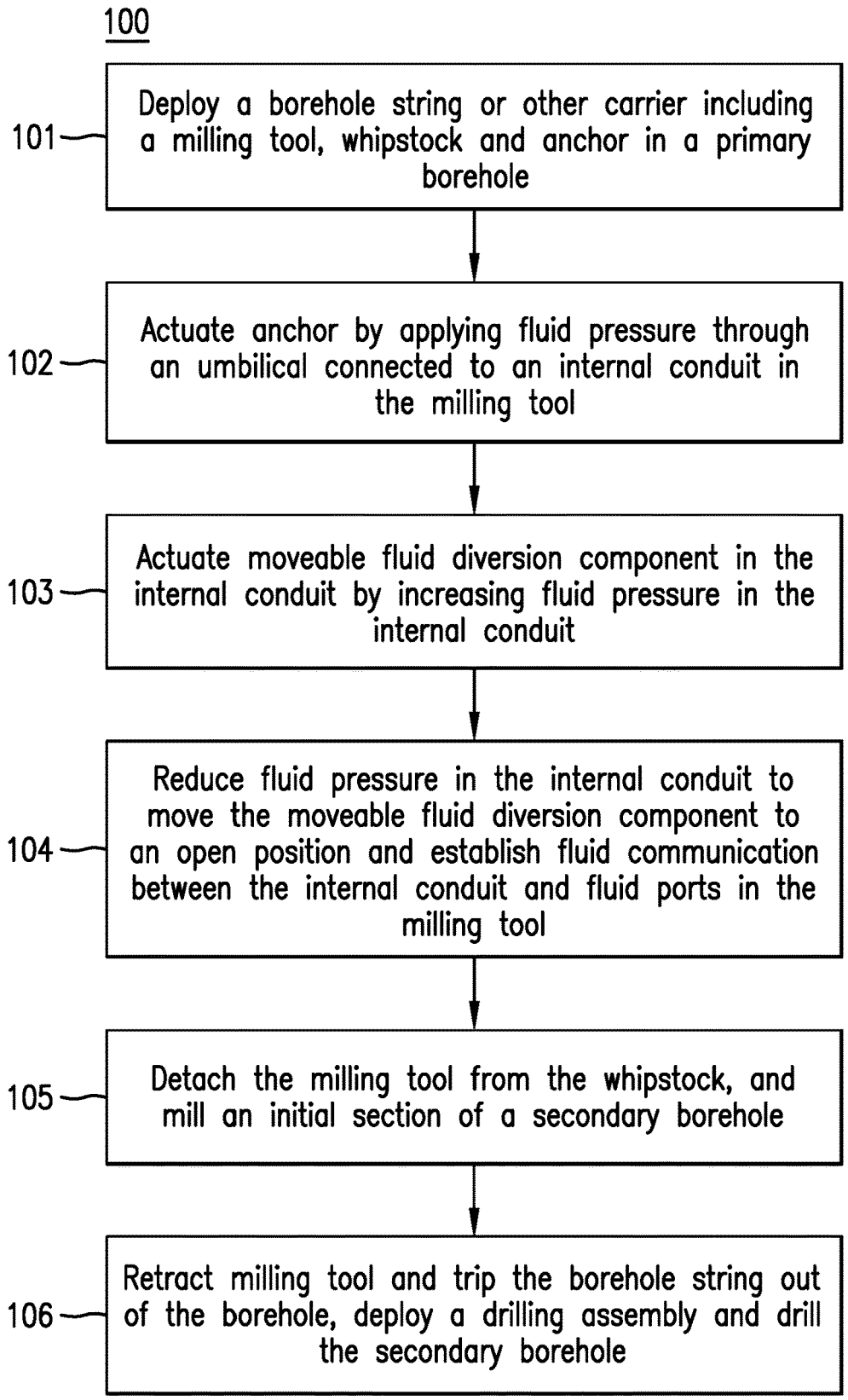
FIG. 8 is a flow chart depicting aspects of a milling operation.

FIG. 8 illustrates a method 100 of performing aspects of a milling operation. The milling operation is described in conjunction with a sidetracking operation but is not so limited and can be used with any operation that employs a downhole mill. Aspects of the method 100 may be performed by a processor such as the surface processing unit 84 and/or the downhole processor 82, either automatically or through input by a human operator.

The method 100 is discussed in conjunction with the system 10 and the embodiment of the fluid diversion assembly shown in FIGS. 3-5, but is not limited thereto.

The method 100 includes one or more of stages 101-106 described herein. In one embodiment, the method 100 includes the execution of all of stages 101-106 in the order described. However, certain stages 101-106 may be omitted, stages may be added, or the order of the stages changed.

In the first stage 101, a borehole string 12 and a milling assembly 20 is deployed into a main borehole. The milling assembly 20 is deployed so that a lead mill 24 is at a kick-off position from which a secondary borehole is to be formed. The milling assembly 20 includes a whipstock 34 and a hydraulically set anchor 36.

In the second stage 102, the anchor 36 is set to secure the anchor 36 and the whipstock 34 at a fixed location. In one embodiment, the anchor 36 is set by increasing flow rate and/or pressure from the surface into the borehole string 12 to close a whipstock valve 40. The flow rate and/or pressure is selected so that the flow rate and/or pressure is less than that needed to operate a fluid diversion assembly 50. For example, the whipstock valve 40 can be configured to so that a pressure of about 500 pounds per square inch (psi) to about 700 psi closes the whipstock valve 40. To close the whipstock valve 40, pressure is increased and held in the borehole string 12 to establish a closed system (i.e., fluid is not circulated into the annulus at this point).

When the whipstock valve 40 is closed, fluid pressure and/or flow rate is increased to activate the anchor 36. For example, fluid in the closed system is increased (e.g., to about 2000 psi) to shear screws in the anchor 36 and extend bladders or arms to abut the borehole wall. A push-pull test may be performed on the borehole string 12 to ensure that the anchor 36 is properly set.

In the third stage 103, the sleeve 52 is actuated to move the sleeve 52 from the first (closed) position to an intermediate position. For example, pressure in the closed system is increased to an activation pressure of, e.g., about 2500 psi. The increased pressure forces the sleeve 52 downward (i.e., toward the cutting end of the lead mill 24). At this stage (shown for example in FIG. 5), the spring 62 is compressed, the guide pins are at position P2, and the sealing component 98 on the inner surface of the internal fluid conduit 54 continues to prevent fluid from flowing to the fluid ports 56.

In the fourth stage 104, pressure is reduced below the activation pressure. The reduction in pressure allows the spring 62 to move the sleeve upward (i.e., away from the cutting end of the lead mill 24). At this stage (shown for example in FIG. 6), the wall of the sleeve 52 has moved past the sealing component 98 and away from the sealing component 98. Fluid can now flow through the passages 94, through the end of the internal fluid conduit 54 and into the fluid ports 56. The borehole string 12 now defines an open system, so that fluid can be circulated through the borehole string 12 and the lead mill 24 and into the annulus to the surface.

In the fifth stage 105, the lead mill 24 is detached from the whipstock 34. For example, weight is applied to the borehole string 12 such that a sufficient force is applied to shear the shear bolt 44 (e.g., about 35,000-45,000 pounds). The lead mill 24 and the milling assembly 20 is rotated and advanced along the whipstock 24 to mill an initial portion (a rathole) of a secondary borehole.

In the sixth stage 106, in one embodiment, the milling assembly 20 is tripped out of the borehole, and a drilling assembly is subsequently deployed into the borehole to drill the secondary borehole. In other embodiments, the milling assembly 20 may include a drill bit or other type of bit and include components that permit that milling assembly 20 to be further advanced to drill the secondary borehole.

It is noted that the method can include various other functions. For example, sensors such as the pressure and/or flow rate sensors 74 and 76 can be used to monitor pressure and/or flow rate during the above stages. In addition, various other measurements can be performed, e.g., via one or more LWD tools, to evaluate the formation and/or monitor conditions of fluid in the borehole and/or operation of downhole components.

The systems and methods described herein provide various advantages over prior art techniques. The milling assembly and fluid diversion assembly according to embodiments described herein eliminate the need to employ more complex and/or more fragile means for diverting fluid for milling. For example, conventional milling systems that utilize hydraulically set anchors include a rupture disc within a lead mill. In such systems, after the anchor is set, pressure is gradually increased to rupture the disc in the lead mill and commence milling Rupture discs are relatively fragile and require precise manufacturing to properly operate. In addition, rupture discs can fail prematurely. Embodiments described herein eliminate the need for internal rupture discs and thereby avoid issues associated with rupture discs. In addition, the fluid diversion assembly described herein can be configured to have more reliable collapse values by selecting associated stiffness properties of the spring.

Set forth below are some embodiments of the foregoing disclosure:

Embodiment 1: An apparatus for performing aspects of a milling operation, the apparatus including: a mill configured to be rotated to mill a section of a borehole, the mill including an internal fluid conduit in fluid communication with a borehole string, the mill including a fluid port configured to connect the internal fluid conduit to an exterior of the mill; a moveable flow diversion component configured to move axially in the internal conduit from a first axial position in which fluid is prevented from flowing between the internal fluid conduit and the fluid port, to a second axial position in which the internal fluid conduit is in fluid communication with the fluid port; and one or more slots formed in the flow diversion component and configured to engage one or more pins extending into the internal fluid conduit, the one or more slots defining a path that directs movement of the flow diversion component, wherein the flow diversion component is configured to be moved from the first axial position to the second axial position by changing fluid pressure in the internal fluid conduit.

Embodiment 2: The apparatus as in any prior embodiment wherein the one or more slots are J-slots.

Embodiment 3: The apparatus as in any prior embodiment, further including a biasing component configured to bias the flow diversion component toward the first position.

Embodiment 4: The apparatus as in any prior embodiment, wherein the biasing component is a spring disposed in the internal fluid conduit.

Embodiment 5: The apparatus as in any prior embodiment, wherein the flow diversion component is configured to move axially in a first direction from the first axial position to an intermediate axial position in response to an increase in pressure in the internal fluid conduit, and move in a second opposing direction from the intermediate axial position to the second axial position in response to a decrease in pressure in the internal fluid conduit.

Embodiment 6: The apparatus as in any prior embodiment, wherein the flow diversion component is a cylindrical sleeve having one or more passages extending through a wall of the sleeve.

Embodiment 7: The apparatus as in any prior embodiment, wherein the fluid port extends from an inner surface of the internal fluid conduit, and the wall of the sleeve is configured to prevent fluid from flowing into the fluid port when the sleeve is in the first position, and the one or more passages are configured to align with the fluid port and permit fluid flow through the one or more passages to the fluid port when the sleeve is in the second position.

Embodiment 8: The apparatus as in any prior embodiment, wherein the flow diversion component is a cylindrical sleeve, and the internal fluid conduit includes a sealing component fixedly disposed at an interior surface of the internal fluid conduit, the sealing component forming a fluid tight seal between an interior surface and a wall of the cylindrical sleeve, wherein: the fluid tight seal prevents fluid flow from the internal fluid conduit to the fluid port when the sleeve is in the first position, and the wall is separated from the sealing component to permit fluid flow from the internal fluid conduit to the fluid port when the sleeve is in the second position.

Embodiment 9: The apparatus as in any prior embodiment, wherein the mill is releasably attached to a whipstock, and the internal fluid conduit is connected to an umbilical configured to connect the internal fluid conduit to an anchor.

Embodiment 10: The apparatus as in any prior embodiment, wherein the fluid diversion component is configured to obstruct the umbilical to prevent fluid flow into the umbilical when the moveable fluid diversion component is in the second position.

Embodiment 11: A method of performing aspects of a milling operation, the method including: deploying a milling assembly in a borehole, the milling assembly including a mill having an internal fluid conduit in fluid communication with a borehole string, the mill including a fluid port configured to connect the internal fluid conduit to an exterior of the mill, the milling assembly including a moveable flow diversion component configured to move axially in the internal conduit from a first axial position in which fluid is prevented from flowing between the internal fluid conduit and the fluid port, to a second axial position in which the internal fluid conduit is in fluid communication with the fluid port; and controlling fluid pressure in the internal fluid conduit on the flow diversion component to move the flow diversion component from the first axial position to the second axial position, wherein movement of the flow diversion component is guided by one or more pins extending into the internal fluid conduit and engaging one or more slots formed in the flow diversion component, the one or more slots defining a path that directs the movement of the flow diversion component; and circulating fluid through the borehole string and the mill and rotating the mill to form an initial section of a secondary borehole that extends from the borehole.

Embodiment 12: The method as in any prior embodiment, wherein the one or more slots are J-slots.

Embodiment 13: The method as in any prior embodiment, wherein the milling assembly includes a biasing component configured to bias the flow diversion component toward the first position.

Embodiment 14: The method as in any prior embodiment, wherein the biasing component is a spring disposed in the internal fluid conduit.

Embodiment 15: The method as in any prior embodiment, wherein controlling the fluid pressure includes increasing the fluid pressure to move the flow diversion component axially in a first direction from the first axial position to an intermediate axial position, and decreasing the fluid pressure to move the flow diversion component from the intermediate axial position to the second axial position.

Embodiment 16: The method as in any prior embodiment, wherein the moveable component is a cylindrical sleeve having one or more passages extending through a wall of the sleeve.

Embodiment 17: The method as in any prior embodiment, wherein the fluid port extends from an inner surface of the internal fluid conduit, and the wall of the sleeve is configured to prevent fluid from flowing into the fluid port when the sleeve is in the first position, and the one or more passages are configured to align with the fluid port and permit fluid flow through the one or more passages to the fluid port when the sleeve is in the second position.

Embodiment 18: The method as in any prior embodiment, wherein the flow diversion component is a cylindrical sleeve, and the internal fluid conduit includes a sealing component fixedly disposed at an interior surface of the internal fluid conduit, the sealing component forming a fluid tight seal between the interior surface and a wall of the cylindrical sleeve, wherein: the fluid tight seal prevents fluid flow from the internal fluid conduit to the fluid port when the sleeve is in the first position, and the wall is separated from the sealing component to permit fluid flow from the internal fluid conduit to the fluid port when the sleeve is in the second position.

Embodiment 19: The method as in any prior embodiment, wherein the mill is releasably attached to a whipstock, and the internal fluid conduit is connected to an umbilical configured to connect the internal fluid conduit to an anchor.

Embodiment 20: The method as in any prior embodiment, wherein the moveable fluid diversion component is configured to obstruct the umbilical to prevent fluid flow into the umbilical when the moveable fluid diversion component is in the second position.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An apparatus for performing aspects of a milling operation, the apparatus comprising:

a mill configured to be rotated to mill a section of a borehole, the mill including an internal fluid conduit in fluid communication with a borehole string, the mill including a fluid port configured to connect the internal fluid conduit to an exterior of the mill, the fluid port located within an interior of the mill, the internal fluid conduit connected to a second fluid conduit that extends from the mill and the internal fluid conduit to an anchor;

a moveable flow diversion component disposed in the mill and configured to move axially in the internal conduit within the mill from a first axial position in which fluid is prevented from flowing between the internal fluid conduit and the fluid port, to a second axial position in which the internal fluid conduit is in fluid communication with the fluid port and fluid is permitted to flow through the fluid port and the mill; and one or more slots formed in the flow diversion component and configured to engage one or more pins extending into the internal fluid conduit, the one or more slots defining a path that directs movement of the flow diversion component, wherein the flow diversion component is configured to be moved from the first axial position to the second axial position by changing fluid pressure in the internal fluid conduit.

2. The apparatus of claim 1, wherein the one or more slots are J-slots.

3. The apparatus of claim 1, further comprising a biasing component configured to bias the flow diversion component toward the first position.

4. The apparatus of claim 3, wherein the fluid conduit fluid diversion component is configured to obstruct entry of fluid from the internal fluid to the second fluid conduit when the fluid diversion component is at the second axial position.

5. The apparatus of claim 1, wherein the flow diversion component is configured to move axially in a first direction from the first axial position to an intermediate axial position in response to an increase in pressure in the internal fluid conduit, and move in a second opposing direction from the intermediate axial position to the second axial position in response to a decrease in pressure in the internal fluid conduit.

6. The apparatus of claim 1, wherein the flow diversion component is a cylindrical sleeve having one or more passages extending through a wall of the sleeve.

7. The apparatus of claim 6, wherein the fluid port extends from an inner surface of the internal fluid conduit, and the wall of the sleeve is configured to prevent fluid from flowing into the fluid port when the sleeve is in the first position, and the one or more passages are configured to be in fluid communication with the fluid port and permit fluid flow through the one or more passages to the fluid port when the sleeve is in the second position.

8. The apparatus of claim 1, wherein the flow diversion component is a cylindrical sleeve, and the internal fluid conduit includes a sealing component fixedly disposed at an interior surface of the internal fluid conduit, the sealing component forming a fluid tight seal between the interior surface and a wall of the cylindrical sleeve, wherein:

the fluid tight seal prevents fluid flow from the internal fluid conduit to the fluid port when the sleeve is in the first position, and the wall is separated from the sealing component to permit fluid flow from the internal fluid conduit to the fluid port when the sleeve is in the second position.

9. The apparatus of claim 1, wherein the mill is releasably attached to a whipstock, and the second fluid conduit includes an umbilical configured to connect the internal fluid conduit to the anchor.

10. The apparatus of claim 9, wherein the umbilical is configured to transmit fluid pressure to set the anchor in place.

11. A method of performing aspects of a milling operation, the method comprising:

deploying a milling assembly in a borehole, the milling assembly including a mill having an internal fluid conduit in fluid communication with a borehole string, the mill including a fluid port configured to connect the internal fluid conduit to an exterior of the mill, the fluid port located within an interior of the mill, the internal fluid conduit connected to a second fluid conduit that extends from the mill and the internal fluid conduit to an anchor, the milling assembly including a moveable flow diversion component disposed in the mill and configured to move axially in the internal conduit within the mill from a first axial position in which fluid is prevented from flowing between the internal fluid conduit and the fluid port, to a second axial position in which the internal fluid conduit is in fluid communication with the fluid port and fluid is permitted to flow through the fluid port and the mill;

controlling fluid pressure in the internal fluid conduit on the flow diversion component to move the flow diversion component from the first axial position to the second axial position, wherein movement of the flow diversion component is guided by one or more pins extending into the internal fluid conduit and engaging one or more slots formed in the flow diversion component, the one or more slots defining a path that directs the movement of the flow diversion component; and circulating fluid through the borehole string and the mill and rotating the mill to form an initial section of a secondary borehole that extends from the borehole.

12. The method of claim 11, wherein the one or more slots are J-slots.

13. The method of claim 11, wherein the milling assembly includes a biasing component configured to bias the flow diversion component toward the first position, the biasing component including a spring disposed in the internal fluid conduit.

14. The method of claim 13, wherein the fluid conduit fluid diversion component obstructs entry of fluid from the internal fluid to the second fluid conduit when the fluid diversion component is at the second axial position.

15. The method of claim 11, wherein controlling the fluid pressure includes increasing the fluid pressure to move the flow diversion component axially in a first direction from the first axial position to an intermediate axial position, and decreasing the fluid pressure to move the flow diversion component from the intermediate axial position to the second axial position.

16. The method of claim 11, wherein the moveable component is a cylindrical sleeve having one or more passages extending through a wall of the sleeve.

17. The method of claim 16, wherein the fluid port extends from an inner surface of the internal fluid conduit, and the wall of the sleeve is configured to prevent fluid from flowing into the fluid port when the sleeve is in the first position, and the one or more passages are configured to be in fluid communication with the fluid port and permit fluid flow through the one or more passages to the fluid port when the sleeve is in the second position.

18. The method of claim 11, wherein the flow diversion component is a cylindrical sleeve, and the internal fluid conduit includes a sealing component fixedly disposed at an interior surface of the internal fluid conduit, the sealing component forming a fluid tight seal between the interior surface and a wall of the cylindrical sleeve, wherein:

the fluid tight seal prevents fluid flow from the internal fluid conduit to the fluid port when the sleeve is in the first position, and the wall is separated from the sealing component to permit fluid flow from the internal fluid conduit to the fluid port when the sleeve is in the second position.

19. The method of claim 11, wherein the mill is releasably attached to a whipstock, and the second fluid conduit includes an umbilical configured to connect the internal fluid conduit to the anchor.

20. The method of claim 19, wherein the umbilical is configured to transmit fluid pressure to set the anchor in place.

* * * * *